US008361245B2

(12) United States Patent
Sakamoto et al.

(10) Patent No.: US 8,361,245 B2
(45) Date of Patent: Jan. 29, 2013

(54) STEEL EXCELLENT IN RESISTANCE TO SULFURIC ACID DEW POINT CORROSION

(75) Inventors: Shunji Sakamoto, Kitakyushu (JP); Satoshi Nishimura, Kitakyushu (JP); Akira Usami, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 11/884,964

(22) PCT Filed: Feb. 24, 2006

(86) PCT No.: PCT/JP2006/004018

§ 371 (c)(1),
(2), (4) Date: Aug. 22, 2007

(87) PCT Pub. No.: WO2006/093240

PCT Pub. Date: Sep. 8, 2006

(65) Prior Publication Data

US 2008/0166256 A1 Jul. 10, 2008

(30) Foreign Application Priority Data

Feb. 28, 2005 (JP) ..... 2005-054246

(51) Int. Cl.
*C22C 38/00* (2006.01)

(52) U.S. Cl. ..... 148/307; 420/87; 420/89

(58) Field of Classification Search ..... 148/307; 420/87, 89

See application file for complete search history.

(56) References Cited

U.S. PATENT DOCUMENTS

| | | | | |
|---|---|---|---|---|
| 3,443,934 | A | 5/1969 | Kubota et al. | |
| 3,620,856 | A * | 11/1971 | Hideto | 148/121 |
| 4,915,901 | A * | 4/1990 | Shimada et al. | 420/119 |
| 6,171,547 | B1 | 1/2001 | Sagara et al. | |
| 6,773,518 | B2 | 8/2004 | Yoon et al. | |

FOREIGN PATENT DOCUMENTS

| | | | |
|---|---|---|---|
| JP | 43-014585 | | 6/1968 |
| JP | 59-083748 | | 5/1984 |
| JP | 2-170921 | | 7/1990 |
| JP | 05255806 | * | 10/1993 |
| JP | 6-108200 | | 4/1994 |
| JP | 6-108201 | | 4/1994 |
| JP | 6-240366 | | 8/1994 |
| JP | 6-287642 | | 10/1994 |
| JP | 8-100238 | | 4/1996 |
| JP | 8-104945 | | 4/1996 |
| JP | 8-176734 | | 7/1996 |
| JP | 09-025536 | | 1/1997 |
| JP | 09-176800 | | 7/1997 |
| JP | 10-110237 | | 4/1998 |
| JP | 10-219397 | | 8/1998 |
| JP | 10-310843 | | 11/1998 |
| JP | 11131179 | * | 5/1999 |
| JP | 2000-17382 A | | 1/2000 |
| JP | 2000017382 | * | 1/2000 |
| JP | 2000-073138 | | 3/2000 |
| JP | 2002-327236 A | | 11/2002 |
| JP | 2003-213367 | | 7/2003 |
| JP | 2004-068039 | | 3/2004 |
| JP | 3574806 B2 | | 10/2004 |
| KR | 10-2001-0109931 | | 12/2001 |
| KR | 10-0920816 | | 10/2009 |

OTHER PUBLICATIONS

M. Kowaka, et al., "*Corrosion Resistant Steel to Sulfur Dewpoint Corrosion*," Sumitomo Metal 23(3): 273-281 (1971).

M. Goto, et al., "*The Polarization Behavior of Fe and Fe-0.3% Cu in Acidic Sulfate Solutions*," Kawasaki Steel Technical Reports 1(3): 238-247 (1969).

European Search Report dated Mar. 21, 2012, issued in corresponding European Application No. EP 06728580.9.

Office Action Oct. 26, 2010 in the corresponding Indian Patent application, Application No. 5328/DELNP/2007.

* cited by examiner

*Primary Examiner* — Sikyin Ip
(74) *Attorney, Agent, or Firm* — Kenyon & Kenyon LLP

(57) ABSTRACT

The present invention provides a steel material able to secure a superior corrosion resistance in a sulfuric acid dew point corrosive environment of exhaust gas obtained by burning high S-containing fuel, containing, by mass %, C: ≦0.010%, Si: ≦0.10%, Cu: 0.05 to 1.00%, P: ≦0.030%, S: ≦0.050%, and Al: ≦0.10% and comprising a balance of Fe and unavoidable impurities. Further, this steel contains one type or two types or more of Sb, Sn, Cr, Mn, Mo, Ni, Nb, V, Ti, and B.

5 Claims, No Drawings

STEEL EXCELLENT IN RESISTANCE TO SULFURIC ACID DEW POINT CORROSION

TECHNICAL FIELD

The present invention relates to a steel material excellent in resistance to sulfuric acid dew point corrosion used in flues, smokestacks, boiler air preheaters, and other facilities exposed to exhaust gas resulting from burning of heavy oil, coal, garbage, etc.

TECHNICAL FIELD

If burning fuel containing sulfur, the exhaust gas contains SOx. This bonds with the moisture in the exhaust gas to form sulfuric acid. If the exhaust gas drops in temperature and reaches the dew point of sulfuric acid, the sulfuric acid gas condenses and corrodes the steel material.

To deal with this problem of sulfuric acid dew point corrosion, steel materials have been developed giving corrosion resistance in a sulfuric acid environment in the past. For example, as seen in Japanese Patent Publication (B) No. 43-14585, low alloy steel to which Sb and Cu have been added complexly, effective in sulfuric acid corrosion resistance, is being supplied for practical use. Further, Japanese Patent Publication (A) No. 9-25536 discloses steel comprised of low-S copper-containing steel in which Sb or Sn is included to maintain the sulfuric acid resistance while improving the hydrochloric acid resistance. Further, Japanese Patent Publication (A) No. 10-110237 discloses steel of steel ingredients similar to Japanese Patent Publication (A) No. 9-25536 and improved in sulfuric acid resistance and hydrochloric acid resistance and including Mo or B to improve the hot rollability.

However, conventional steel cannot give sufficient corrosion resistance for plants using high-S-containing fuel with an S content of over 2%. If the S content becomes high, the exhaust gas rises in sulfuric acid concentration and the amount of condensation of sulfuric acid accompanying a drop in temperature increases, so the result becomes a corrosive environment harsher than the case of low-S-containing fuel. For this reason, the type of steel able to give a superior corrosion resistance in a relatively mild environment of a S content of 2% or less does not necessarily give a superior corrosion resistance in a high-S fuel environment. The problem remains of development of new types of steel to secure stable corrosion resistance regardless of the S content.

DISCLOSURE OF THE INVENTION

In view of the above situation, the present invention provides a steel material able to secure excellent corrosion resistance in a sulfuric acid dew point corrosive environment of exhaust gas obtained by burning high-S-containing fuel.

The present inventors first used test materials of various types of steel ingredients to run sulfuric acid immersion tests and other various types of laboratory tests. However, if using the same materials for exposure tests in actual plants, the types of steel giving superior corrosion resistance in laboratory tests are not necessarily superior in actual plants. Rather, completely opposite results sometimes are obtained. For example, Si was effective in sulfuric acid resistance in laboratory tests, but it was learned that it is sometimes a harmful element and sometimes harmless or ineffective in actual exposure tests.

In the past, Si is known as an element improving the sulfuric acid corrosion resistance, but has been recognized as an element to be contained in a range over 0.8 (for example, Wakabayashi et al., *Sumitomo Metal*, Vol. 23, No. 3, p. 279, 1971). The inventors engaged in studies through actual plant exposure tests and as a result positioned Si as rather an element causing the deterioration of the sulfuric acid corrosion resistance. This detrimental effect of Si is in interaction with the C content. The inventors obtained the discoveries that in steel with a low C content, this effect appears particularly conspicuously and becomes remarkable in the case of plants using fuel with a high S content. In the past, Si had been recognized as effective based on the results of investigation of the effects of Si predicated on steel with a C content of 0.1% or so. It may be explained that if the steel changes in base ingredients, the action of the Si also changes.

The conventional mechanism regarding efficacy of Si is not necessarily definitely clarified, but the corrosion product $SiO_2$ is stable even in a strongly acidic environment, so one view is that the $SiO_2$ precipitated at the steel surface reduces the active points of cathodic reaction or anodic reaction and thereby suppresses the corrosion reaction. Papers attributing this mechanism of improvement of the corrosion resistance to the active points of cathodic reaction or anodic reaction report on the usefulness of the main alloying element Cu of sulfuric acid resistant steel (for example, Goto et al., *Kawasaki Steel Technical Reports*, Vol. 1, No. 3, p. 24, 1969). A similar mechanism is believed to stand for Si as well.

On the other hand, regarding the mechanism relating to the detrimental effect of Si discovered by the present inventors, in actual plants, the steel surface is repeatedly raised in temperature and lowered in temperature, so the sulfuric acid condenses and vaporizes, whereby the rust layer repeatedly grows and peels off. Taking note of this, the inventors ran cycle corrosion tests consisting of immersing a corrosion test piece in sulfuric acid, then raising the temperature for drying so as to investigate the behavior in forming a rust layer of samples of various types of steel ingredients. Part of the rust layer of each sample after the cycle corrosion test is made to peel off to find peeled rust weight, then the weight of the fixed rust is found so as to find the corrosion loss. As a result, it was learned that if the Si content becomes higher, the ratio of the weight of the peeled rust in the weight of the rust layer as a whole combining the peeled rust and fixed rust becomes higher and, further, that the larger the amount of the peeled rust, the greater the corrosion loss. This experimental phenomenon cannot be explained by the conventional mechanism relating to reaction active points explaining the usefulness of Si and suggests that a mechanism independent from the conventional mechanism is predominantly acting. That is, Si has an effect on the composition and structure of corrosion products deposited on the steel surface and acts to facilitate peeling of the rust layer. For this reason, it can be said that Si is harmful to sulfuric acid corrosion resistance.

Regarding C, it is believed that the lower the C, the more the steel sheet falls in strength and the more the residual stress falls after cold working, so the harder the peeling of the rust layer.

The above-mentioned discovery became clear for the first time by actual plant tests using ultralow C-based steel as a test material and laboratory tests simulating actual plant characteristics and could be predicted from the history by which conventional steel ingredients were designed through simple sulfuric acid immersion tests.

From the above, the present inventors selected an exposure test at actual plants as means for overall evaluation of the corrosion resistance including also the peelability of the rust layer and ran exposure tests at various actual plants. As a result, to reach the conclusion that to obtain satisfactory sulfuric acid corrosion resistance in a plant burning fuel with an S content of over 2%, it is necessary to include a suitable quantity of Cu and greatly reduce the contents of the two elements of Si and C.

Further, by extreme reduction of the Si and C, it becomes possible to reduce the content of Cu required for securing sulfuric acid resistance in the past. Cu is known as an element for impairing the hot rollability. As seen in Japanese Patent Publication (A) No. 10-110237, the inventors discovered that sulfuric acid resistant steel had problems in improvement of the hot rollability, but by greatly reducing the Si and C and keeping down the lowest amount of Cu content for maintaining the corrosion resistance, this problem can also be eliminated.

The present invention was formed based on the above discovery and has as its gist the following:

(1) Steel excellent in resistance to sulfuric acid dew point corrosion containing, by mass %, C: ≦0.010%, Si: 40.10%, Cu: 0.05 to 1.00%, P: 10.030%, S: 10.050%, and Al: 10.10% and comprising a balance of Fe and unavoidable impurities and having a sulfuric acid corrosion resistance indicator R value found by the following equation <1> of −0.90 or less:

$$R=\log([Si]+\alpha\times[C]) \quad <1>$$

where, α is defined by the following equation <2>, [Si] is the mass % of Si, [C] is the mass % of C, and log is a common logarithm.

$$13\times\log(\alpha+400\times[C])=100\times[C]+1.1 \quad <2>$$

(2) Steel excellent in resistance to sulfuric acid dew point corrosion containing, by mass %, C: ≦0.010%, Si: ≦0.050%, Cu: 0.05 to 1.00%, P: ≦0.030%, S: ≦0.050%, and Al: ≦0.10% and comprising a balance of Fe and unavoidable impurities and having a sulfuric acid corrosion resistance indicator R value found by the following equation <1> of −1.10 or less.

$$R=\log([Si]+\alpha\times[C]) \quad <1>$$

where, α is defined by the following equation <2>, [Si] is the mass % of Si, [C] is the mass % of C, and log is a common logarithm.

$$13\times\log(\alpha+400\times[C])=100\times[C]+1.1 \quad <2>$$

(3) Steel excellent in resistance to sulfuric acid dew point corrosion containing, by mass %, C: ≦0.010%, Si: ≦0.010%, Cu: 0.05 to 1.00%, P: ≦0.030%, S: ≦0.050%, and Al: ≦0.10% and comprising a balance of Fe and unavoidable impurities and having a sulfuric acid corrosion resistance indicator R value found by the following equation <1> of −1.30 or less.

$$R=\log([Si]+\alpha\times[C]) \quad <1>$$

where, α is defined by the following equation <2>, [Si] is the mass % of Si, [C] is the mass % of C, and log is a common logarithm.

$$13\times\log(\alpha+400\times[C])=100\times[C]+1.1 \quad <2>$$

(4) Steel excellent in resistance to sulfuric acid dew point corrosion as set forth in any of (1) to (3) characterized by further containing as steel ingredients, by mass %, one type or two types or more of Sb: 0.01 to 0.30%, Sn: 0.01 to 0.30%, Cr: 0.1 to 3.0%, Mn: 0.1 to 3.0%, Mo: 0.01 to 1.00%, Ni: 0.01 to 0.50%, Nb: 0.01 to 0.10%, V: 0.01 to 0.10%, Ti: 0.01 to 0.10%, and B: 0.0003 to 0.0030%.

(5) Steel excellent in resistance to sulfuric acid dew point corrosion characterized by containing, by mass %, C: ≦0.010%, Si: ≦0.10%, Cu: 0.05 to 0.30%, P: ≦0.030%, S: ≦0.050%, and Al: ≦0.10% and comprising a balance of Fe and unavoidable impurities and having a sulfuric acid corrosion resistance indicator R value found by the following equation <1> of −0.90 or less.

$$R=\log([Si]+\alpha\times[C]) \quad <1>,$$

where, α is defined by the following equation <2>, [Si] is the mass % of Si, [C] is the mass % of C, and log is a common logarithm.

$$13\times\log(\alpha+400\times[C])=100\times[C]+1.1 \quad <2>$$

(6) Steel excellent in resistance to sulfuric acid dew point corrosion characterized by containing, by mass %, C: ≦0.010%, Si: ≦0.050%, Cu: 0.05 to 0.30%, P: ≦0.030%, S: ≦0.050%, and Al: ≦0.10% and comprising a balance of Fe and unavoidable impurities and having a sulfuric acid corrosion resistance indicator R value found by the following equation <1> of −1.10 or less.

$$R=\log([Si]+\alpha\times[C]) \quad <1>,$$

where, α is defined by the following equation <2>, [Si] is the mass % of Si, [C] is the mass % of C, and log is a common logarithm.

$$13\times\log(\alpha+400\times[C])=100\times[C]+1.1 \quad <2>$$

(7) Steel excellent in resistance to sulfuric acid dew point corrosion containing, by mass %, C: ≦0.010%, Si: ≦0.010%, Cu: 0.05 to 0.30%, P: ≦0.030%, S: ≦0.050%, and Al: ≦0.10% and comprising a balance of Fe and unavoidable impurities and having a sulfuric acid corrosion resistance indicator R value found by the following equation <1> of −1.30 or less.

$$R=\log([Si]+\alpha\times[C]) \quad <1>,$$

where, α is defined by the following equation <2>, [Si] is the mass % of Si, [C] is the mass % of C, and log is a common logarithm.

$$13\times\log(\alpha+400\times[C])=100\times[C]+1.1 \quad <2>$$

(8) Steel excellent in resistance to sulfuric acid dew point corrosion as set forth in any of (5) to (7) characterized by further containing as steel ingredients by, mass %, one type or two types or more of Sb: 0.01 to 0.30%, Sn: 0.01 to 0.30%, Cr: 0.1 to 3.0%, Mn: 0.1 to 3.0%, Mo: 0.01 to 1.00%, Ni: 0.01 to 0.50%, Nb: 0.01 to 0.10%, V: 0.01 to 0.10%, Ti: 0.01 to 0.10%, and B: 0.0003 to 0.0030%.

BEST MODE FOR WORKING THE INVENTION

Below, the present invention will be explained in detail.

The reasons for limitation of the steel ingredients in the present invention will be explained.

C: As explained above, the lower the C, the lower the steel sheet in residual stress, so it is believed that there is the effect of prevention of peeling of the rust layer, so the content is preferably as low in level as possible, to obtain a satisfactory corrosion resistance, it has to be suppressed to 0.010% or less.

Si: Si has been considered to improve the conventional corrosion resistance, but the present inventors engaged in studies and as a result found that it is an element harmful to the corrosion resistance. Accordingly, the Si content has to be suppressed to as low a level as possible. 0.10% is made the upper limit. Preferably, it is 0.050% or less, more preferably 0.010% or less. The extreme reduction of the Si gives rise to a remarkable synergic effect when combined with the extreme reduction of the C.

Cu: An element essential for improvement of the corrosion resistance, so included in an amount of 0.05% or more, but if included over 1.00%, remarkably degrades the hot rollability, so the upper limit is made 1.00%. From the viewpoint of the hot rollability, the upper limit of the desirable content is 0.30%.

P: An impurity remaining in the refining process. If remaining over 0.050%, the corrosion resistance deteriorates, so the upper limit is made 0.050%.

S: Like P, an impurity. If remaining over 0.050%, the corrosion resistance deteriorates, so the upper limit is made 0.050%.

Al: May also be included for the purpose of deoxidation in the refining process, but if included over 0.10%, the hot rollability deteriorates, so the upper limit is made 0.10%.

R value: A sulfuric acid corrosion resistance indicator based on the interaction of C and Si, so the value calculated by the following equation <1> has to be limited to −0.90 or less. If this is exceeded, rust easily peels off and the corrosion resistance is reduced. The preferable R value is −1.10 or less, more preferably −1.30 or less.

$$R=\log([Si]+\alpha\times[C]) \quad <1>$$

where, α is defined by the following equation <2>, [Si] is the mass % of Si, [C] is the mass % of C, and log is a common logarithm.

$$13\times\log(\alpha+400\times[C])=100\times[C]+1.1 \quad <2>$$

The steel of the present invention has the above elements as basic ingredients, but in addition to these elements and Fe, the following elements may be included for the purpose of improvement of the corrosion resistance, the adjustment of mechanical characteristics, and the improvement of the hot rollability.

Sb, Sn: Elements effective for improvement of the corrosion resistance, but if less than 0.01%, the effect does not appear, while if over 0.30%, the hot rollability tends to deteriorate, so the content is suitably 0.01 to 0.30%.

Cr, Mn: Elements effective for strengthening. In accordance with the application of the steel material, when it is necessary to make up for the drop in strength due to the extreme reduction of C and Si, suitable quantities are included. The desirable content is 0.10% or more, but if included over 3.00%, the corrosion resistance deteriorates until the effect of improvement of the corrosion resistance due to the extreme reduction of C, Si is cancelled out, so the upper limit is made 3.00%.

Mo: An element contributing to improvement of the corrosion resistance when the exhaust gas contains hydrogen chloride, but if a large amount is included, the corrosion resistance with respect to sulfuric acid deteriorates, so a content of 0.01 to 1.00% is a suitable range.

Ni: Can be utilized for preventing deterioration of the hot rollability of Cu, but if over 0.50% is included, the corrosion resistance tends to deteriorate, so when included, 0.50% is made the upper limit.

Nb, V, Ti: Elements forming precipitates and effective for increasing toughness, but it is included over 0.10%, the corrosion resistance tends to deteriorate, so if added, are added preferably with the upper limit of 0.10%.

B: Extreme reduction of C causes the grain boundary strength to fall, so this is useful for suppressing grain boundary fracture caused during working. Further, useful as an element able to suppress deterioration of the hot rollability which becomes a problem when corrosion resistance improving elements such as Cu, Sb, and Sn are included in large amounts. If less than 0.0005%, sufficient effects cannot be obtained, but if over 0.030%, conversely the hot rollability deteriorates, so a content of 0.0005 to 0.0030% is suitable.

As applications for the steel comprised of the above composition, boiler related facilities in a thermal power plant, a sulfuric acid refining facility and storage tank in a chemical plant, a pickling tank in a steel making plant, or various other diverse types of facilities and equipment used in sulfuric acid environments may be mentioned, but among these, it is most suitable for heat exchanging elements of rotary regenerative type air preheaters attached to commercial thermal power plants or civilian use boilers.

EXAMPLES

Examples will be used to explain the present invention in more detail.

Steel of each of the chemical ingredients shown in Table 1 was melted in a vacuum melting furnace and cast to 50 kg ingot, then hot rolled, cold rolled, and annealed. A 0.5×50×150 mm size strip-shaped test piece was sampled from the obtained sheet material, set at the low temperature end of the air preheater of a boiler fueled by heavy oil and coal, subjected to an exposure test, and measured for corrosion loss. The S content in the fuel was 0.5 to 3.1%, while the temperature condition was 110 to 130° C.

The test results are shown in Table 2. Under a relatively mild condition of an S content of 0.5%, even with the steel of the comparative example, a corrosion resistance substantially the same as the present invention is obtained. However, in a harsh environment where the S content aimed at in the present invention is over 2%, Comparative Example Nos. 11 and 14 had a C content or Si content and R value over the present invention in range, while Nos. 12, 13 had C and Si contents and R values all over the present invention in range, so satisfactory corrosion resistances could not be obtained. On the other hand, the amounts of corrosion of Invention Example Nos. 1 to 8 became fractions of that of Comparative Example, so there was clear superiority.

TABLE 1

Chemical Ingredients of Test Material (mass %)

| Class | No. | C | Si | Mn | P | S | Cu | Al | Others | R value |
|---|---|---|---|---|---|---|---|---|---|---|
| Inv. ex. | 1 | 0.0008 | 0.005 | 0.13 | 0.008 | 0.006 | 0.32 | 0.025 | | −2.25 |
| | 2 | 0.0028 | 0.008 | 0.35 | 0.009 | 0.010 | 0.32 | 0.026 | Sb: 0.10%, Ni: 0.15% | −2.00 |
| | 3 | 0.0029 | 0.007 | 0.15 | 0.009 | 0.010 | 0.29 | 0.024 | Sb: 0.11%, Cr: 1.31% | −2.04 |
| | 4 | 0.0029 | 0.004 | 0.25 | 0.009 | 0.010 | 0.33 | 0.026 | Cr: 1.25% | −2.21 |
| | 5 | 0.0069 | 0.048 | 0.33 | 0.010 | 0.011 | 0.33 | 0.025 | Sn: 0.05% | −1.21 |
| | 6 | 0.0029 | 0.077 | 0.21 | 0.009 | 0.010 | 0.31 | 0.025 | B: 0.0010% | −1.10 |
| | 7 | 0.0028 | 0.004 | 1.97 | 0.008 | 0.011 | 0.32 | 0.026 | Sb: 0.11%, Ti: 0.03%, Nb: 0.03% | −2.22 |
| | 8 | 0.0027 | 0.009 | 2.01 | 0.008 | 0.011 | 0.50 | 0.018 | Sb: 0.11%, Mo: 0.5%, V: 0.03% | −1.96 |
| Comp. ex. | 11 | 0.0150 | 0.050 | 0.51 | 0.009 | 0.011 | 0.25 | 0.032 | | −0.38 |
| | 12 | 0.0150 | 0.270 | 0.35 | 0.014 | 0.006 | 0.27 | 0.027 | Ni: 0.15%, Sb: 0.09% | −0.19 |
| | 13 | 0.0901 | 0.281 | 0.87 | 0.011 | 0.006 | 0.28 | 0.033 | Cr: 1.25% | 7.95 |
| | 14 | 0.0020 | 0.260 | 0.34 | 0.020 | 0.004 | 0.03 | 0.043 | Mo: 0.05% | −0.58 |

Underlined parts in the table outside range of the present invention

TABLE 2

| Class | No. | Corrosion speed (mm/year) | | |
|---|---|---|---|---|
| | | [S] = 0.5% | [S] = 2.1% | [S] = 3.1% |
| Inv. ex. | 1 | 0.04 | 0.11 | 0.15 |
| | 2 | 0.06 | 0.09 | 0.11 |
| | 3 | 0.07 | 0.08 | 0.21 |
| | 4 | 0.06 | 0.11 | 0.14 |
| | 5 | 0.06 | 0.12 | 0.13 |
| | 6 | 0.07 | 0.09 | 0.14 |
| | 7 | 0.06 | 0.09 | 0.12 |
| | 8 | 0.07 | 0.08 | 0.15 |
| Comp. ex. | 11 | 0.06 | 0.41 | 0.78 |
| | 12 | 0.07 | 0.38 | 0.55 |
| | 13 | 0.05 | 0.28 | 0.61 |
| | 14 | 0.06 | 0.31 | 0.81 |

INDUSTRIAL APPLICABILITY

According to the present invention, a steel material exhibiting excellent corrosion resistance even in a harsh sulfuric acid condensation corrosive environment.

The invention claimed is:

1. Steel excellent in resistance to sulfuric acid dew point corrosion consisting of, by mass %, C: ≦0.010%, Si: ≦0.10%, Cu: 0.05 to 1.00%, P: ≦0.030%, S: ≦0.011%, Cr: 1.25 to 3.0%, and Al: ≦0.10%, and a balance of Fe and unavoidable impurities and having a sulfuric acid corrosion resistance indicator R value found by the following equation <1> of −0.90 or less:

$$R=\log([Si]+\alpha\times[C]) \quad <1>$$

where, α is defined by the following equation <2>, [Si] is the mass % of Si, [C] is the mass % of C, and log is a common logarithm.

$$13\times\log(\alpha+400\times[C])=100\times[C]+1.1 \quad <2>$$

2. Steel excellent in resistance to sulfuric acid dew point corrosion consisting of, by mass %, C: ≦0.010%, Si: ≦0.050%, Cu: 0.05 to 1.00%, P: ≦0.030%, S: ≦0.011%, Cr: 1.25 to 3.0%, and Al: ≦0.10%, and a balance of Fe and unavoidable impurities and having a sulfuric acid corrosion resistance indicator R value found by the following equation <1> of −1.10 or less:

$$R=\log([Si]+\alpha\times[C]) \quad <1>$$

where, α is defined by the following equation <2>, [Si] is the mass % of Si, [C] is the mass % of C, and log is a common logarithm.

$$13\times\log(\alpha+400\times[C])=100\times[C]+1.1 \quad <2>$$

3. Steel excellent in resistance to sulfuric acid dew point corrosion consisting of, by mass %, C: ≦0.010%, Si: ≦0.010%, Cu: 0.05 to 1.00%, P: ≦0.030%, S: ≦0.011%, Cr: 1.25 to 3.0%, and Al: ≦0.10%, and a balance of Fe and unavoidable impurities and having a sulfuric acid corrosion resistance indicator R value found by the following equation <1> of −1.30 or less:

$$R=\log([Si]+\alpha\times[C]) \quad <1>$$

where, α is defined the following equation <2>, [Si] is the mass % of Si, [C] is the mass % of C, and log is a common logarithm.

$$13\times\log(\alpha+400\times[C])=100\times[C]+1.1 \quad <2>$$

4. Steel excellent in resistance to sulfuric acid dew point corrosion consisting of, by mass %, C: ≦0.010%, Si: ≦0.10%, Cu: 0.05 to 1.00%, P: ≦0.030%, S: ≦0.011%, Al: ≦0.10%, Cr: 1.25 to 3.0%, Sb: 0.01 to 0.30%, and one or two or more of Sn: 0.01 to 0.30%, Mn: 0.1 to 3.0%, Mo: 0.01 to 1.00%, Ni: 0.01 to 0.15%, Nb: 0.01 to 0.10%, V: 0.01 to 0.10%, Ti: 0.01 to 0.10%, and B: 0.0003 to 0.0030%, and a balance of Fe and unavoidable impurities and having a sulfuric acid corrosion resistance indicator R value found by the following equation <1> of −0.90 or less:

$$R=\log([Si]+\alpha\times[C]) \quad <1>$$

where, α is defined by the following equation <2>, [Si] is the mass % of Si, [C] is the mass % of C, and log is a common logarithm $$13\times\log(\alpha+400\times[C])=100\times[C]+1.1 \quad <2>.$$

5. The steel of claim 1, wherein Si: ≦0.009%.

* * * * *